US010670201B1

(12) United States Patent
Noble

(10) Patent No.: US 10,670,201 B1
(45) Date of Patent: Jun. 2, 2020

(54) HEADLAMP WITH LIGHT SOURCE ON REMOVABLE SLOTTED BODY

(71) Applicant: 5.11, Inc., Manteca, CA (US)

(72) Inventor: Matthew Noble, Long Beach, CA (US)

(73) Assignee: 5.11, INC., Manteca, CA (US)

( * ) Notice: Subject to any disclaimer, the term of this patent is extended or adjusted under 35 U.S.C. 154(b) by 0 days.

(21) Appl. No.: 16/446,055

(22) Filed: Jun. 19, 2019

(51) Int. Cl.

| | |
|---|---|
| ***F21V 21/00*** | (2006.01) |
| ***F21L 4/02*** | (2006.01) |
| ***F21L 4/00*** | (2006.01) |
| ***F21V 21/088*** | (2006.01) |
| ***F21V 19/00*** | (2006.01) |
| ***F21V 33/00*** | (2006.01) |

(52) U.S. Cl.
CPC ..... *F21L 4/025* (2013.01); *F21L 4/005* (2013.01); *F21L 4/027* (2013.01); *F21V 19/0015* (2013.01); *F21V 21/088* (2013.01); *F21V 33/0008* (2013.01)

(58) Field of Classification Search
CPC . F21L 4/022; F21L 4/025; F21L 4/027; F21L 4/02; F21L 4/005; F21V 19/0015; F21V 21/088; F21V 21/0816; F21V 21/084; F21V 21/0885; F21V 33/0008
USPC ..... 362/105, 103, 184, 171, 172, 197, 396
See application file for complete search history.

(56) References Cited

U.S. PATENT DOCUMENTS

| | | | |
|---|---|---|---|
| 6,575,587 | B2 | 6/2003 | Cramer et al. |
| 6,736,529 | B1 | 5/2004 | Lee |
| 6,877,875 | B2 | 4/2005 | Yu et al. |
| 7,281,826 | B2 | 10/2007 | Huang |
| 7,427,149 | B2 | 9/2008 | Sohn |
| 7,568,812 | B1 | 8/2009 | Kumthampinij et al. |
| 8,038,311 | B2 | 10/2011 | Lau |
| 8,066,396 | B2 | 11/2011 | Hunt |

(Continued)

FOREIGN PATENT DOCUMENTS

| | | |
|---|---|---|
| GB | 2376519 | * 12/2002 |
| GB | 2499433 | 8/2013 |

OTHER PUBLICATIONS

"Fenix HL10 LED Flashlight—2016", Fenix®, fenix-store.com, Available Online at https://www.fenix-store.com/fenix-hll0-led-flashlight-2016/Discloses a headlamp with detachable flashlight, Accessed from Internet on Jun. 24, 2019, 5 pages.

(Continued)

*Primary Examiner* — Laura K Tso
(74) *Attorney, Agent, or Firm* — Kilpatrick Townsend & Stockton LLP

(57) ABSTRACT

An illumination system can include a flashlight removable from a headlamp docking base with a C-shaped bracket. The flashlight can have a bifurcated body defined by a shaft and a bar each attached to a lateral side of a head and spaced apart from one another to define a slot. The shaft can define a battery housing. A first light source on a front side of the head and a second light source on the bar may each be on a front face of the flashlight. The flashlight may be selectively secured among different structures by selectively performing actions including at least: mounting the flashlight to the base by inserting the shaft of the flashlight into the C-shaped bracket of the base; and mounting the flashlight to a substrate by sliding the slot of the flashlight over an edge of the substrate.

17 Claims, 3 Drawing Sheets

(56) References Cited

U.S. PATENT DOCUMENTS

| | | | | |
|---|---|---|---|---|
| 8,148,912 | B2 | 4/2012 | Kim | |
| 8,444,285 | B2 | 5/2013 | Lau | |
| 8,545,069 | B2 | 10/2013 | Mccaslin et al. | |
| 8,616,722 | B2 * | 12/2013 | Duerr | F21V 21/084 362/191 |
| D719,286 | S | 12/2014 | Inskeep | |
| 8,992,039 | B2 | 3/2015 | Janice | |
| D733,951 | S | 7/2015 | Kent | |
| 9,157,623 | B2 | 10/2015 | Hui | |
| D743,598 | S | 11/2015 | Inskeep | |
| 9,249,964 | B2 | 2/2016 | Hansen et al. | |
| 9,416,929 | B2 | 8/2016 | Inskeep | |
| 9,583,028 | B2 * | 2/2017 | Killion | F21V 7/0075 |
| 9,649,873 | B2 * | 5/2017 | Alzhrany | B43K 29/10 |
| 9,693,425 | B2 | 6/2017 | Feustel et al. | |
| 9,726,356 | B2 | 8/2017 | Ormsbee et al. | |
| 9,810,385 | B1 * | 11/2017 | Bonds | F21L 4/005 |
| 9,872,531 | B2 | 1/2018 | Uke et al. | |
| 2007/0153501 | A1 * | 7/2007 | Kinsman | F21V 21/0885 362/105 |
| 2008/0205036 | A1 | 8/2008 | Tarter et al. | |
| 2008/0212311 | A1 * | 9/2008 | Peterson | F21V 21/0885 362/106 |
| 2008/0298048 | A1 | 12/2008 | Garrity et al. | |
| 2010/0165612 | A1 * | 7/2010 | Yeh | F21V 21/0885 362/190 |
| 2010/0214766 | A1 * | 8/2010 | Hunt | F21L 4/00 362/105 |
| 2010/0277894 | A1 * | 11/2010 | Kim | F21L 4/00 362/105 |
| 2012/0236543 | A1 | 9/2012 | Torgerson | |
| 2013/0182423 | A1 * | 7/2013 | Matthews | A45F 5/02 362/191 |
| 2013/0329412 | A1 * | 12/2013 | Ko | F21L 4/045 362/191 |
| 2015/0016094 | A1 * | 1/2015 | Yamai | F21V 21/084 362/105 |
| 2017/0224093 | A1 | 8/2017 | Yao | |

OTHER PUBLICATIONS

"Fenix HL50 LED Headlamp", Fenix®, fenix-store.com, Available Online at https://www.fenix-store.com/fenix-hl50-led-headlamp/, Accessed from Internet on Jun. 24, 2019, 9 pages.

"Generic LED Headlamp USB XM-L2 Headlight Waterproof Frontal Flashlight Zoomable Led Head Torch 18650 Rechargeable Battery Camping Light BIL", Jumia, jumia.co.ke, Available Online at https://www.jumia.co.ke/generic-led-headlamp-usb-xm-l2-headlight-waterprooffrontal-flashlight-zoomable-led-head-torch-18650-rechargeable-battery-campinglight-bil-13910006.html, Accessed from Internet on Jun. 24, 2019, 7 pages.

"HL1 Rotary-Switch Variable-Output Detachable Headlamp", ooLots, toolots.com, TPIN: NFT8KW5UD, https://www.toolots.com/tlls-hll-rotary-switch-variable-output-detachableheadlampls.html, Accessed from Internet on Jun. 24, 2019, 10 pages.

* cited by examiner

HEADLAMP WITH LIGHT SOURCE ON REMOVABLE SLOTTED BODY

BACKGROUND

A variety of headlamps and flashlights exist. Typically, flashlights are carried in a user's hand, and directionality of the light projected by the flashlight can be controlled by the user moving his or her hand or arm. In contrast, headlamps customarily include one or more headband straps that are designed to secure a light source on a user's head. Thus, directionality of projected light from a headlamp is usually controlled by the user moving his or her head. While headlamps in many situations are convenient to wear on the head to allow hands-free illumination, headlamps may be cumbersome to use by hand, for example, in light of headband straps having a propensity to dangle from the user's hand when the headlamp is gripped or a propensity to form an unwieldy bunch if collected within the user's hand.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Embodiments herein are directed to flashlights, for example, which may form a removable component of a headlamp system. The flashlights may feature a bifurcated body that may define a slot between a cylindrical battery housing and a rectangular tab that bears a light source. In use, the cylindrical battery housing of the flashlight may be snapped into C-shaped brackets of a headlamp base and allow the light source's projection angle to be vertically pivoted up or down relative to the user's forehead by rotating the cylindrical battery housing within the C-shaped brackets. The flashlight may also be removed from the headlamp base to allow gripping by hand or use in an alternate mounting mode in which the slot between cylindrical battery housing and the light-bearing tab can be slipped over a pocket lip, fabric edge, or the like to attach the flashlight to gear other than the headlamp base and provide illumination from that mounted position.

In various examples, a flashlight may include a body that includes a head, a bar, a shaft, and a slot. The bar can have a proximal bar end joined to the head and a distal bar end extending away from the head. The shaft can define a battery housing. The shaft can have a proximal shaft end joined to the head and a distal shaft end extending away from the head. The shaft can extend alongside and be spaced apart from the bar. The slot can be defined between the bar and the shaft. The flashlight can also include a first light source positioned on the head and a second light source positioned on the bar.

In various examples, an illumination system includes a docking base and a removable flashlight. The docking base can include a panel configured to be attached to a headband or other gear. The docking base can also include a C-shaped bracket projecting from the panel. The removable flashlight can include a shaft, a head, and a bar. The shaft may be releasably received in the C-shaped bracket. The head may have a lateral side attached to the shaft. The head may further have a front side bearing a first light source. The bar may be attached to the lateral side of the head and may bear a second light source. The bar may be spaced apart from the shaft so as to define a slot between the bar and the shaft.

In various examples, a method can include accessing a flashlight having a slotted body defining a slot between a bar and a shaft joined at one end by a head. The method can further include selectively securing the flashlight among different structures by selectively performing actions. The actions can include at least: mounting the flashlight to a base by inserting the shaft of the flashlight into a C-shaped bracket of the base; and mounting the flashlight to a substrate by sliding the slot of the flashlight over an edge of the substrate.

For a fuller understanding of the nature and advantages of the present invention, reference should be made to the ensuing detailed description and accompanying drawings. Other aspects, objects and advantages of the invention will be apparent from the drawings and the detailed description that follows.

BRIEF DESCRIPTION OF THE DRAWINGS

Various embodiments in accordance with the present disclosure will be described with reference to the drawings.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
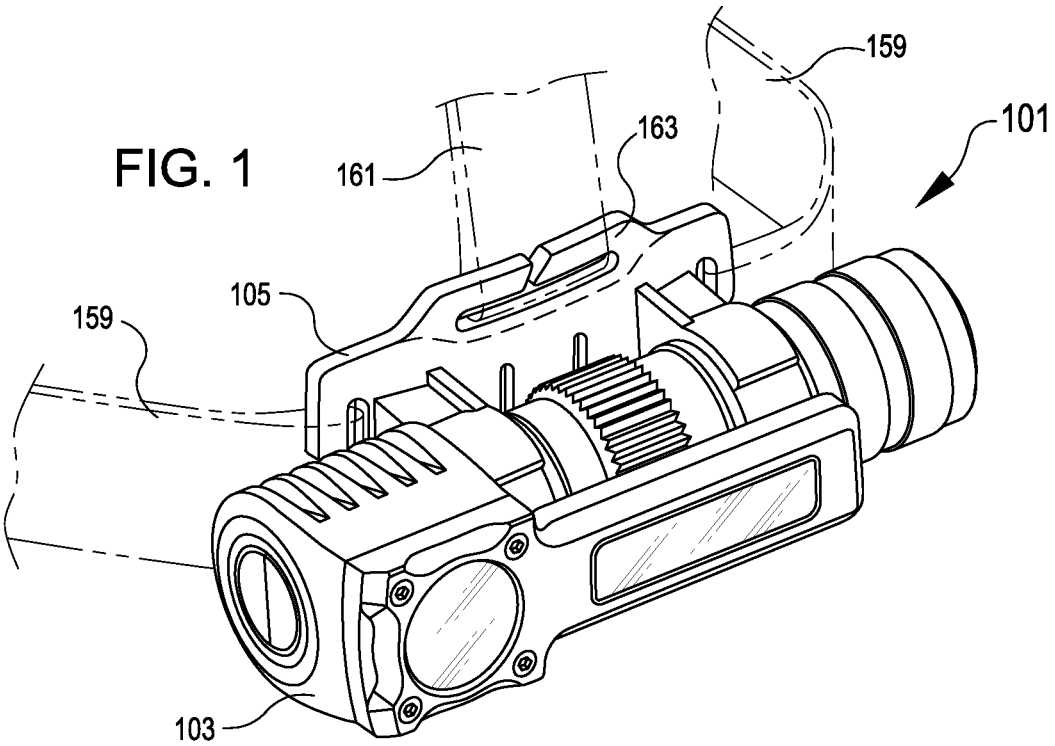
FIG. 1 is a perspective view of an example of an illumination system according to certain embodiments.

Referring now to the drawings, in which like reference numerals represent like parts throughout the several views, FIG. 1 shows an illumination system 101. Illumination system 101 in FIG. 1 is shown with a flashlight 103 releasably secured relative to a dock or docking base 105.

Figure 2:
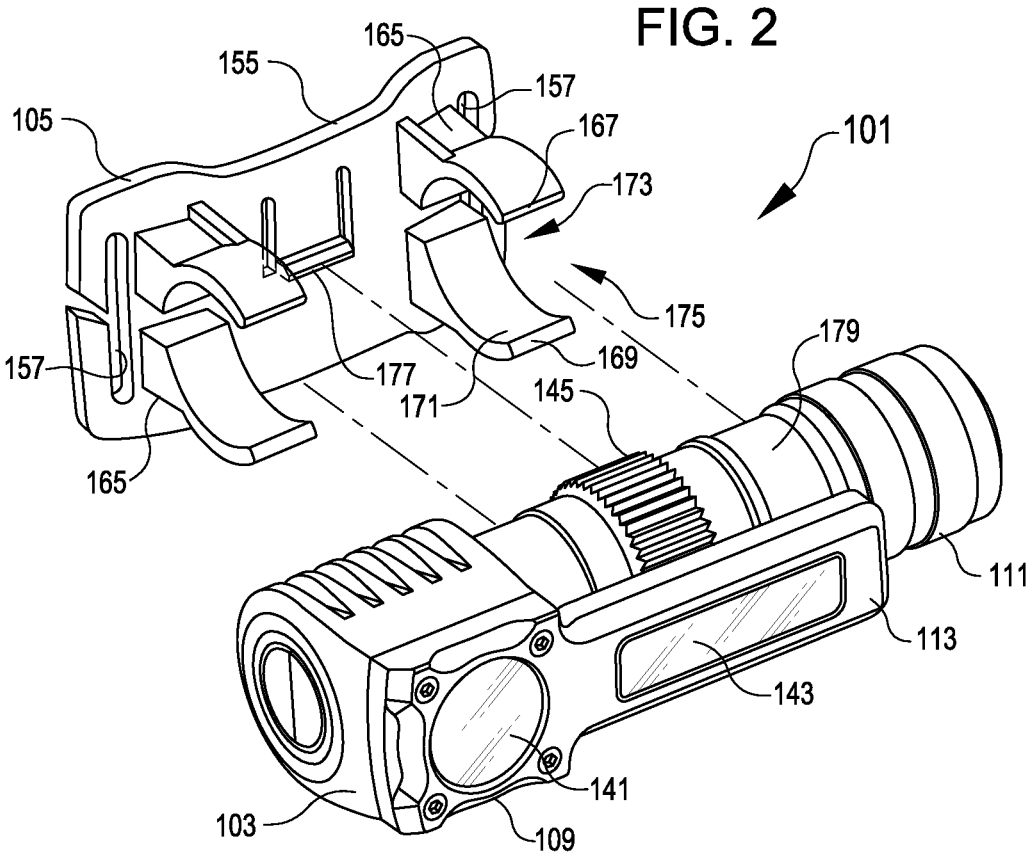
FIG. 2 is an exploded view of the illumination system of FIG. 1 according to certain embodiments.

FIG. 2 illustrates an exploded assembly view of elements of the illumination system 101. For example, FIG. 2 illustrates that the flashlight 103 may be a removable flashlight 103 that is removable from the base 105 (e.g., thus providing a removable portion of a headlamp). The flashlight 103 can include suitable mounting features. For example, some features of the flashlight 103 can allow the flashlight 103 to mount relative to the base 105. The flashlight 103 additionally or alternatively can include features that allow attaching to other structures, which may include garments or other forms of gear, for example, as described herein with respect to FIG. 8.

Figure 4:
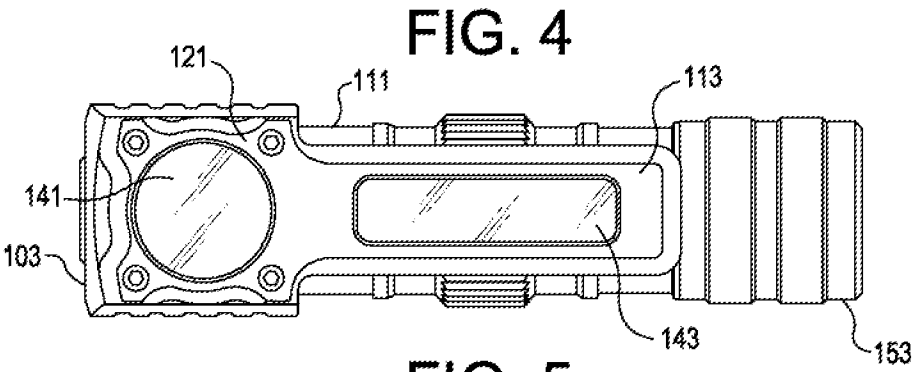
FIG. 4 is a front view of the flashlight of FIG. 3 according to certain embodiments.
Figure 5:
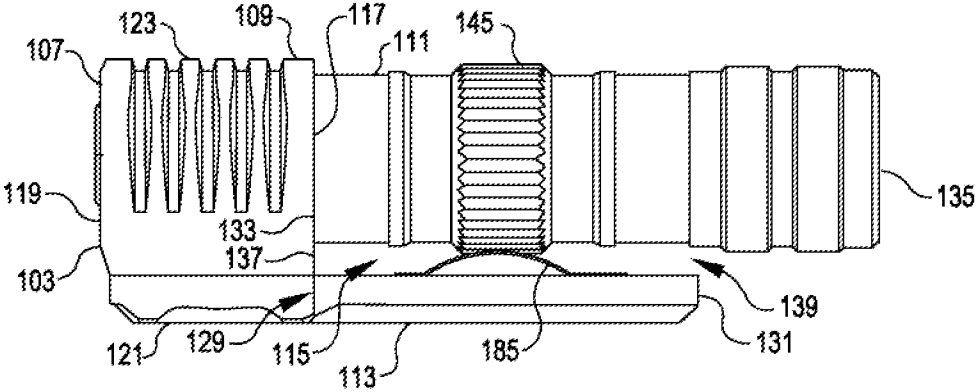
FIG. 5 is a top view of the flashlight of FIG. 3 according to certain embodiments.
Figure 6:
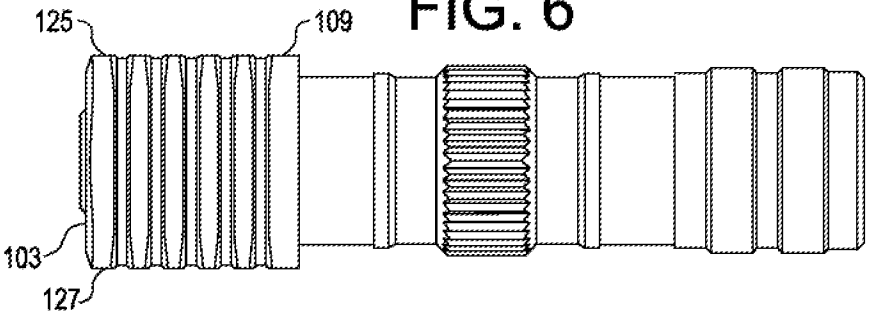
FIG. 6 is a rear view of the flashlight of FIG. 3 according to certain embodiments.
Figure 7:
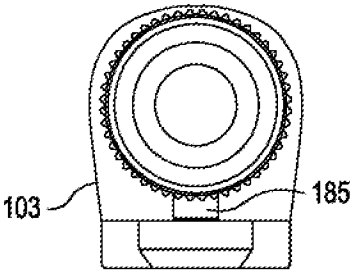
FIG. 7 is a right end view of the flashlight of FIG. 3 according to certain embodiments.
Figure 3:
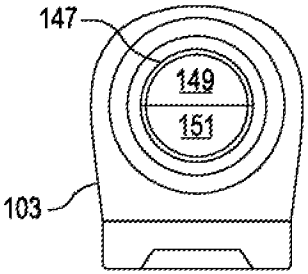
FIG. 3 is a left end view of an example of flashlight from the illumination system of FIGS. 1-2 according to certain embodiments.

FIGS. 3-7 depict various views of the flashlight 103 in isolation from the base 105 of FIG. 2. For example, left and right end views are respectively shown in FIGS. 3 and 7, front and rear views are respectively shown in FIGS. 4 and 6, and a top view is shown in FIG. 5 (where a bottom view may be a mirror image of FIG. 5).

As may be best seen in FIG. 5, the flashlight 103 can be defined by a body 107. The body can include a head 109, a shaft 111, and a bar 113. A slot 115 may be defined between the shaft 111 and the bar 113. In view of the slot 115, the body 107 may be appropriately described as slotted, bifurcated, and/or forked. Respective portions of the body 107 may be formed of metal, plastic, rubber, or other materials to provide suitable strength and/or weight for the flashlight 103 in use.

The head 109 may have various sides. For example, the head 109 may have a first lateral side 117, (e.g., a right side in FIG. 5), an opposite, second lateral side 119 (e.g., a left side in FIG. 5), a front side 121, a rear side 123, a top side 125 (e.g., FIG. 6), and a bottom side 127 (e.g., FIG. 6).

Referring again to FIG. 5, the first lateral side 117 of the head 109 can be attached (e.g., integrally formed or joined in some other fashion) to each of the shaft 111 and the bar 113. For example, the bar 113 can include a proximal bar end 129 joined to the head 109 on the first lateral side 117, and the bar 113 can also include a distal bar end 131 extending away from the first lateral side 117 of the head 109. Similarly, the shaft 111 can have a proximal shaft end 133 joined to the head 109 on the first lateral side 117, and the shaft 111 can also include a distal shaft end 135 extending away from the first lateral side 117 of the head 109. The shaft 111 and the bar 113 can be spaced apart from one another to define the slot 115. Similar to the shaft 111 and the bar 113, the slot 115 may have a proximal or inner slot end 137 and a distal or outer slot end 139. The inner slot end 137 may be positioned abutting the first lateral side 117 of the head 109 (e.g., adjacent the proximal bar end 129 and/or the proximal shaft end 133) and the outer slot end 139 may be located remote or away from the first lateral side 117 of the head 109 (e.g., toward the distal bar end 131 and/or the distal shaft end 135). The outer slot end 139 of the slot 115 may define an entry into the slot 115 between spaced apart portions of the bar 113 and the shaft 111.

Referring to FIG. 4, a first light source 141 can be included on the head 109. For example, the first light source 141 may be borne on the front side 121 of the head 109. The first light source 141 may be a spotlight. For example, the first light source 141 can include an appropriate bulb, light-emitting diode (LED), or other source of light for providing a beam of light in the form factor of spotlight. The first light source 141 can include or be coupled with an appropriate reflector or lens to enable the spotlight functionality.

A second light source 143 can be borne by or otherwise included on the bar 113. The second light source 143 may be a floodlight. As a non-limiting example, the second light source may be a chip on board ("COB") light source. For example, COB light sources may include multiple LED chips bonded to a substrate and linked within a single circuit to form a single module that may illuminate as a single lighting panel and provide a higher density of lumen output per area and/or a lower heat generation in comparison to a standard LED array. The second light source may additionally or alternatively include any suitable reflector, lens, or other light emitter to enable the floodlight functionality.

The first light source 141 and the second light source 143 can be arranged side by side one another. For example, both may be positioned on a front face of the flashlight 103 that may be formed in part by the head 109 and the bar 113. Providing the first light source 141 and the second light source 143 with different respective spot and floodlight functionality may allow the user to select between different modes of operation of the flashlight 103 according to whichever mode may better fit a given set of circumstances that the user may encounter. The side by side positioning may also allow both the first light source 141 and the second light source 143 to both be adjustable by a same angle in response to rotating the shaft 111 of the flashlight 103. For example, rotation of the shaft 111 about a longitudinal axis of the shaft 111 may causes the first light source 141 and the second light source 142 to each alter an orientation at which light is projected by an equal angle.

The bar 113 is depicted as an elongate rectangular tab, flange, or rail. Elongate may refer to having one dimension (e.g., length) that is substantially greater (e.g., two times or other relevant larger or smaller ratio) than other dimensions (e.g., width or height). However, other form factors that vary from the exact form factor depicted may be utilized. For example, although the bar 113 is depicted as having a generally trapezoidal cross-sectional shape and a front-most flat surface that forms or supports a portion of the second light source 143, the bar 113 may include flat, ridged, curved, or other forms of surfaces. Moreover, although the bar 113 is shown having a length that extends a relative distance that is less than a length of the shaft 111, the bar 113 may be longer than the shaft 111, the same length as the shaft 111, or shorter than the shaft 111 (such as terminating before, at, or after reaching a distance corresponding to the teeth 145 discussed below or other reference feature along the shaft 111). Generally, the bar 113 can include suitable structure for bearing the second light source 143 and/or defining a boundary of the slot 115.

Referring again to FIG. 5, the shaft 111 may provide various functions for the flashlight 103. For example, the shaft 111 may define a battery housing, e.g., sized and shaped for receiving a battery or set of batteries to provide power to the first light source 141 on the head 109 and the second light source 143 on the bar 113. Further, the shaft 111 may include a removable cap 153 that may be removed to facilitate insertion and removal of a battery or set of batteries for powering the flashlight 103. The shaft 111 may be cylindrical (e.g., which may facilitate rotation of the shaft about a longitudinal axis for adjusting the position and/or orientation of the first light source 141 and the second light source 143), although other rounded, semi-rounded, or other form factors may be utilized. The shaft 111 can extend alongside the bar 113 and be spaced apart from the bar 113 to define the slot 115.

The head 109 can include suitable components for facilitating operation of the flashlight 103. For example the head 109 may contain circuitry and/or electronic components capable of relaying power from one or more batteries in the battery housing of the shaft 111 to either or both of the first light source 141 and the second light source 143. A user interface 147 (e.g., FIG. 3) may be provided for turning on and off either or both of the first light source 141 and the second light source 143. For example, in FIG. 3, the user interface 147 is positioned on the head 109 (on the second lateral side 119) and includes a first button portion 149 for turning on and off the first light source 141 and a second button portion 151 for turning on and off the second light source 143.

As previously noted, some features of the flashlight 103 can allow the flashlight 103 to mount relative to the base 105. Conversely, various features of the base 105 may facilitate engagement with the flashlight 103. Various such features the base 105 may be appreciated with reference to FIGS. 1 and 2.

The base 105 depicted in FIG. 2 includes a panel 155. The panel 155 can include one or more slits 157 or other suitable features for receiving or coupling to one or more straps 159. For example, the panel 155 may be coupled with one or more straps 159 for securing the base 105 to a user's head for use in or as a headlamp. In some examples, a strap 159 arranged generally horizontally as a headband around the user's head may be supplemented by a vertically-directed strap 161 that may be attached to a crown 163 or other portion of the base 105 that may be omitted (e.g., the crown 163 is shown in FIG. 1 but absent in FIG. 2). In some examples, the strap 159 may be utilized to secure the panel 155 to a vest, backpack, or other gear use as an alternate mount in lieu of use as a headlamp.

The base 105 depicted in FIG. 2 also includes a C-shaped bracket 165. Two C-shaped brackets 165 are shown in FIG. 2, and although other numbers could be utilized, for simplicity, discussion herein will reference a single C-shaped bracket 165. The C-shaped bracket 165 can project from the panel 155. The C-shaped bracket 165 can include a first tip 167, a second tip 169, and an arcuate surface 171 extending between the first tip 167 and the second tip 169. The arcuate surface may bound an open internal space 173 of the C-shaped bracket 165, and the open internal space 173 may be accessible through an opening 175 defined between the first tip 167 and the second tip 169. The C-shaped bracket 165 may be sized so that the shaft 111 of the flashlight 103 may be releasably received into the C-shaped bracket 165. For example, the shaft 111 of the flashlight 103 may be inserted through the entry opening 175 of the C-shaped bracket 165 and into the open internal space 173 of the C-shaped bracket 165 so that the first tip 167 and the second tip 169 retain the shaft 111 within the C-shaped bracket 165. The C-shaped bracket 165 may allow the shaft 111 to be rotatable within the C-shaped bracket 165 to adjust an angle of light provided by the removable flashlight 103 relative to base 105.

The base 105 depicted in FIG. 2 also includes a detent 177. The detent 177 may engage the shaft 111 to releasably retain the shaft 111 among multiple pivoted configurations.

Turning back to the flashlight 103, some features may be included to facilitate engagement with the base 105. For example, the shaft 111 may include an indentation 179 for receiving the C-shaped bracket 165. Although the indentation 179 is shown in FIG. 2 as formed by a space between raised walls, the indentation 179 could additionally or alternatively be formed as one or more recesses in the shaft 111. As another example, the flashlight 103 is shown in FIG. 2 with at least a partial ring of teeth 145. The teeth 145 may be engageable with the detent from 77 or other portion of the base 105, e.g., so that the shaft 111 can be rotated and retained among multiple pivoted configurations that may correspond to different orientations of light projected by the first light source 141 and second light source 143. For example, rotating the shaft 111 may cause the detent 177 to be displaced out of one gap between teeth 145, flex to deflect while a respective one of the teeth 145 is moved past the detent 177, and resiliently move into engagement into a second gap among the teeth 145. In some examples, the shaft 111 of the flashlight 103 is rotatable within the C-shaped bracket 165 to change a position of the bar 113 of the flashlight 103 and the slot 115 of the flashlight 103 such that a portion of the C-shaped bracket 165 is brought into a position within the slot 115 defined between the shaft 111 and the bar 113 of the flashlight 103. For example, the flashlight 103 may be rotated in the base 105 so that the front side 121 of the head 109 is pointing straight upwards and so that the bar 113 is vertically over the C-shaped bracket 165.

The flashlight 103 can also include features that may facilitate mounting apart from the base 105. For example, referring to FIG. 5, the slot 115 may function as a hooking feature that may allow the flashlight 103 to be supported by sliding a support structure into the slot 115. For example, with reference to FIG. 8, the flashlight 103 may be mounted relative to a pocket lip or other edge 181 of a substrate 183 so that the distal bar end 131 of the bar 113 is on one side of the substrate 183 (e.g., outside a pocket) and so that the distal shaft end 135 of the shaft 111 is on another side of the substrate 183 (e.g., inside a pocket).

Figure 8:
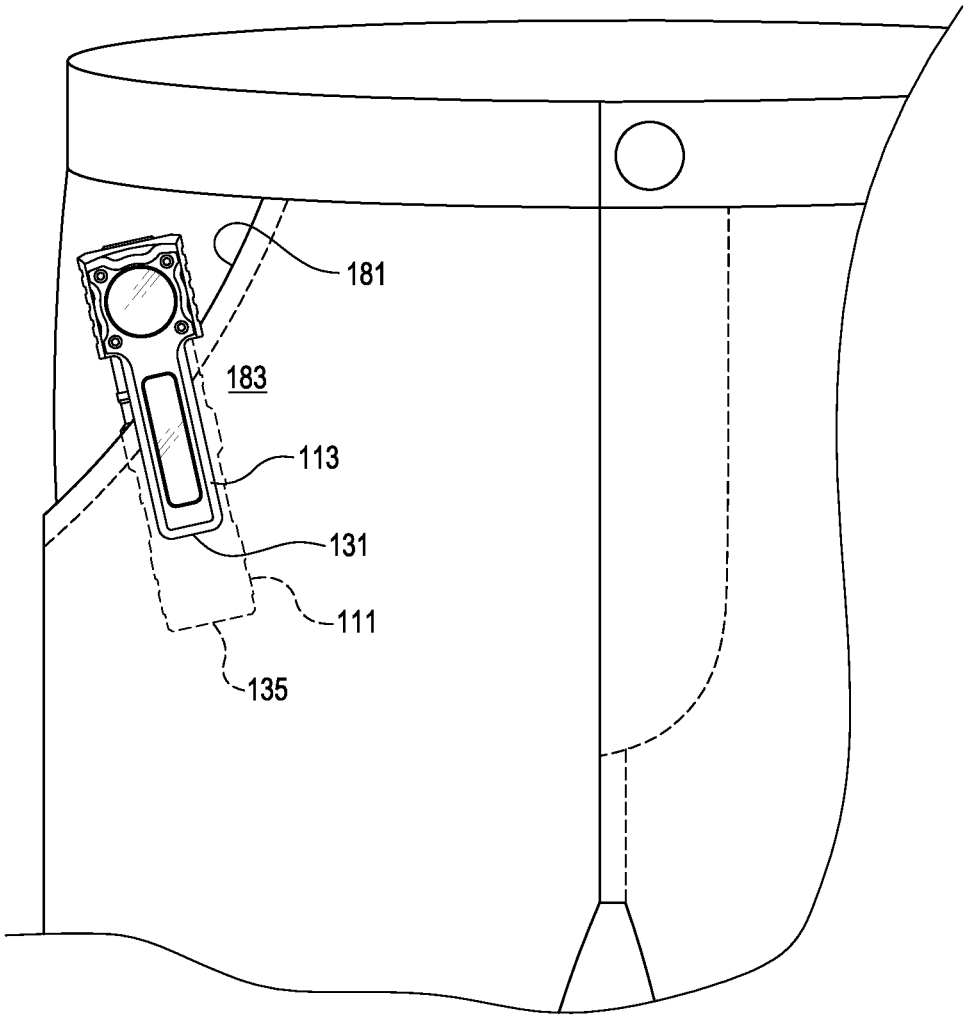
FIG. 8 is a front view of the flashlight of FIGS. 3-7 mounted on pocket according to certain embodiments.

With reference to FIG. 5, the flashlight 103 may also include a clip 185 positioned within the slot 115. The clip 185 is shown affixed to the bar 113 but could alternatively be affixed to the shaft 111. The clip 185 may correspond to a spring clip or other structure that can bias a substrate 183 toward a side of the slot 115 (e.g., toward the bar 113 or the shaft 111) and provide engagement for securing the flashlight 103 relative to the substrate 183. Moreover, although the substrate 183 in FIG. 8 is depicted by way of example as a pants pocket, the substrate 183 in other examples could represent a pocket, fabric layer, or other layer or attachment platform on a shirt, pants, jacket, vest, pack, or other form of gear. Thus, for example, the flashlight 103 may be mounted to a substrate 183 by sliding the slot 115 over an edge 181 of the substrate 183 and may be further secured by engaging the clip 185 with the substrate 183 to releasably attach the flashlight 103 to the substrate 183.

More generally, in use, the flashlight 103 may facilitate a process that involves selectively securing the flashlight 103 among different structures by selectively performing different actions. For example, one action can include mounting the flashlight 103 to the base 105 by inserting the shaft 111 of the flashlight 103 into the C-shaped bracket 165 of the base 105. Such mounting may cause the first light source 141 and the second light source 143 of the flashlight 103 to face away from the base 105 for projecting light at an angle adjustable by rotating the shaft 111 of the flashlight 103 within the C-shaped bracket 165. Another action can include mounting the flashlight 103 to a substrate 183 by sliding the slot 115 of the flashlight 103 over an edge 181 of the substrate 183, e.g., so that the flashlight 103 straddles the substrate 183. Such mounting may cause the first light source 141 and the second light source 143 of the flashlight 103 to face away from the substrate 183 for projecting light outward from the substrate 183.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A flashlight comprising:

a body comprising:

a head;

a bar having a proximal bar end joined to the head and a distal bar end extending away from the head; and a shaft defining a battery housing and having a proximal shaft end joined to the head and a distal shaft end extending away from the head, the shaft extending alongside and spaced apart from the bar;

a slot defined between the bar and the shaft;

a first light source positioned on the head; and a second light source positioned on the bar, wherein the first light source and the second light source are side by side such that rotation of the shaft about a longitudinal axis of the shaft causes the first light source and the second light source to each alter an orientation at which light is projected by an equal angle.

2. The flashlight of claim 1, wherein the first light source positioned on the head comprises a spot light and the second light source positioned on the bar comprises a flood light.

3. The flashlight of claim 1, wherein the shaft is cylindrical; and wherein the bar comprises an elongate rectangular tab having a flat surface that forms or supports a portion of the second light source.

4. The flashlight of claim 1, wherein the slot has an inner end abutting the head.

5. The flashlight of claim 1, further comprising a clip positioned in the slot.

6. An illumination system comprising:

a docking base comprising:

a panel configured to be attached to a headband or other gear; and a C-shaped bracket projecting from the panel; and a removable flashlight comprising:

a shaft releasably received in the C-shaped bracket;

a head having a lateral side attached to the shaft, the head further having a front side bearing a first light source;

a bar attached to the lateral side of the head and bearing a second light source, the bar spaced apart from the shaft so as to define a slot between the bar and the shaft; and a front face, wherein the first light source and the second light source each positioned on the front face.

7. The system of claim 6, wherein the C-shaped bracket comprises:

a first tip;

a second tip; and an arcuate surface extending between the first tip and the second tip, the arcuate surface bounding an open internal space of the C-shaped bracket accessible through an opening defined between the first tip and the second tip.

8. The system of claim 6, further comprising a user interface positioned on the head and configured to turn on and off at least one of the first light source or the second light source.

9. The system of claim 8, wherein the user interface comprises a first button portion for turning on and off the first light source and a second button portion for turning on and off the second light source.

10. The system of claim 6, wherein the shaft is rotatable within the C-shaped bracket to adjust an angle of light provided by the removable flashlight relative to the docking base.

11. The system of claim 6, wherein the shaft comprises at least a partial ring of teeth engageable with the docking base to releasably retain the shaft among multiple pivoted configurations.

12. The system of claim 6, wherein the shaft comprises an indentation for receiving the C-shaped bracket.

13. The system of claim 6, wherein the first light source borne on the front side of the head comprises a bulb or light-emitting diode (LED); and wherein the second light source borne on the bar comprises a chip on board light source.

14. A method comprising:

accessing a flashlight comprising a slotted body defining a slot between a bar and a shaft joined at one end by a head; and selectively securing the flashlight among different structures by selectively performing actions including at least:

mounting the flashlight to a base by inserting the shaft of the flashlight into a C-shaped bracket of the base such that a first light source and a second light source of the flashlight face away from the base for projecting light at an angle adjustable by rotating the shaft of the flashlight within the C-shaped bracket; and mounting the flashlight to a substrate by sliding the slot of the flashlight over an edge of the substrate.

15. The method of claim 14, wherein the base is coupled with a headband such that the flashlight comprises a removable portion of a headlamp.

16. The method of claim 14, wherein the flashlight comprises a clip positioned in the slot and the method further comprises engaging the clip with the substrate to releasably attach the flashlight to the substrate.

17. The method of claim 14, wherein the shaft of flashlight is rotatable within the C-shaped bracket to change a position of the bar of the flashlight and the slot of the flashlight such that a portion of the C-shaped bracket is brought into a position within the slot defined between the shaft and the bar of the flashlight.

* * * * *